US011952987B2

(12) United States Patent
Andersen et al.

(10) Patent No.: US 11,952,987 B2
(45) Date of Patent: Apr. 9, 2024

(54) HYDRAULIC PISTON MACHINE

(71) Applicant: Danfoss A/S, Nordborg (DK)

(72) Inventors: Stig Kildegaard Andersen, Krusaa (DK); Frank Holm Iversen, Padborg (DK); Sveinn Porarinsson, Reykjavik (IS)

(73) Assignee: Danfoss A/S, Nordborg (DK)

( * ) Notice: Subject to any disclaimer, the term of this patent is extended or adjusted under 35 U.S.C. 154(b) by 351 days.

(21) Appl. No.: 17/038,959

(22) Filed: Sep. 30, 2020

(65) Prior Publication Data

US 2021/0148343 A1 May 20, 2021

(30) Foreign Application Priority Data

Nov. 15, 2019 (DE) ..... 102019130844.5

(51) Int. Cl.
*F04B 1/124* (2020.01)
*F04B 1/2021* (2020.01)

(52) U.S. Cl.
CPC ..... *F04B 1/124* (2013.01); *F04B 1/2021* (2013.01)

(58) Field of Classification Search
CPC ..... F04B 1/124; F04B 1/2007; F04B 1/2014; F04B 1/2021; F04B 1/2035; F04B 1/2078; F04B 53/14; F03C 1/0605; F03C 1/0647; F04C 9/002; F04C 21/002; F16J 1/005; F16J 1/006; F16J 1/008
See application file for complete search history.

(56) References Cited

U.S. PATENT DOCUMENTS 2,861,278 A 11/1958 Young
2,998,288 A 8/1961 Newhouse
3,113,491 A 12/1963 Borowka
3,187,644 A * 6/1965 Ricketts ..... F01B 3/0008 92/147
3,633,467 A * 1/1972 Watanabe ..... F04B 1/124 264/269
3,741,077 A * 6/1973 Hulsebus ..... F04B 1/124 92/158
3,747,479 A 7/1973 Nightingale et al.
3,828,654 A * 8/1974 Wiethoff ..... F04B 1/124 92/158
3,861,278 A * 1/1975 Forster ..... F04B 1/124 92/158

(Continued)

FOREIGN PATENT DOCUMENTS

CN 1294036 A 5/2001
CN 1316600 A 10/2001

(Continued)

OTHER PUBLICATIONS

Search Report for Great Britain Patent Application No. GB2017764.8 dated Apr. 7, 2021.

(Continued)

*Primary Examiner* — Dustin T Nguyen
(74) *Attorney, Agent, or Firm* — McCormick, Paulding & Huber PLLC

(57) ABSTRACT

A hydraulic piston machine is described comprising a piston (1) having a hollow (2) secured by a wall (3) and an insert (4) arranged in the hollow. Such a machine should have a high efficiency at low costs. To this end the insert (4) comprises a section (29) which extends out of the hollow (2).

18 Claims, 2 Drawing Sheets

(56) References Cited

U.S. PATENT DOCUMENTS

| | | | | | |
|---|---|---|---|---|---|
| 3,915,071 | A | | 10/1975 | Forster | |
| 3,986,439 | A | | 10/1976 | Ring | |
| 3,999,468 | A | * | 12/1976 | Bristow | F04B 1/124 92/256 |
| 4,009,645 | A | | 3/1977 | Freimuth | |
| 4,191,095 | A | * | 3/1980 | Heyl | F01B 3/0085 92/158 |
| 4,481,867 | A | * | 11/1984 | Nagase | F04B 1/2021 91/487 |
| 5,007,332 | A | | 4/1991 | Wagenseil | |
| 5,072,655 | A | * | 12/1991 | Adler | F04B 1/124 92/158 |
| 5,080,202 | A | | 1/1992 | Tristano et al. | |
| 5,216,943 | A | | 6/1993 | Adler et al. | |
| 5,265,331 | A | * | 11/1993 | Engel | F04B 1/124 92/260 |
| 5,564,903 | A | | 10/1996 | Eccles et al. | |
| 5,730,043 | A | | 3/1998 | Kristensen et al. | |
| 6,120,265 | A | | 9/2000 | Wu | |
| 6,250,206 | B1 | * | 6/2001 | Johnson | F04B 1/124 92/158 |
| 6,293,185 | B1 | * | 9/2001 | Stoppek | B23P 15/10 92/260 |
| 6,318,241 | B1 | | 11/2001 | Stoppek et al. | |
| 6,325,181 | B1 | | 12/2001 | Di Ponio | |
| 2016/0273653 | A1 | | 9/2016 | Tamashina et al. | |
| 2021/0148342 | A1 | | 5/2021 | Andersen et al. | |
| 2021/0148343 | A1 | | 5/2021 | Andersen et al. | |
| 2022/0010786 | A1 | * | 1/2022 | Koide | F04B 53/14 |

FOREIGN PATENT DOCUMENTS

| | | | | | |
|---|---|---|---|---|---|
| CN | 102086852 | A | | 6/2011 | |
| CN | 108105048 | A | | 6/2018 | |
| CN | 210564920 | U | | 5/2020 | |
| DE | 1033028 | | * | 6/1958 | F04B 1/124 |
| DE | 7108800 | | * | 7/1971 | |
| DE | 7108800 | U | | 7/1971 | |
| DE | 2363941 | A1 | | 6/1974 | |
| DE | 2548702 | A1 | | 5/1977 | |
| DE | 3732648 | A1 | | 4/1989 | |
| DE | 69507576 | T2 | | 7/1999 | |
| ES | 2 826 125 | A1 | | 5/2021 | |
| GB | 1127291 | | * | 9/1968 | F04B 1/20 |
| GB | 1332183 | A | | 10/1973 | |
| GB | 1403830 | | | 8/1975 | |
| JP | 2001289170 | A | | 10/2001 | |
| JP | 2001289179 | A | | 10/2001 | |
| WO | 2020/101027 | A1 | | 5/2020 | |
| WO | 2020/114529 | A1 | | 6/2020 | |

OTHER PUBLICATIONS

Search Report for Great Britain Patent Application No. GB2017765.5 dated Apr. 7, 2021.

First Examination Report for Indian Patent Application No. 202014036982 dated Dec. 14, 2021.

Examination Report under Section 18(3) for Great Britain Patent Application No. GB2017765.5, dated May 2, 2023.

* cited by examiner

HYDRAULIC PISTON MACHINE

CROSS-REFERENCE TO RELATED APPLICATION

This application claims foreign priority benefits under 35 U.S.C. § 119 to German Patent Application No. 102019130844.5 filed on Nov. 15, 2019, the content of which is hereby incorporated by reference in its entirety.

TECHNICAL FIELD

The present invention relates to a hydraulic piston machine comprising a piston having a hollow surrounded by a wall and an insert arranged in the hollow.

BACKGROUND

A piston machine is a machine with positive displacement and can be, for example, in the form of an axial piston machine. In an axial piston machine the piston is arranged in a cylinder located in a cylinder drum and rests with one end against an inclined swash plate. When the cylinder drum is rotated, the piston is moved up and down in the cylinder.

Such a machine is used, for example, for pumping a liquid like water. Although water is generally considered as incompressible fluid, it is in fact slightly compressible. The compressibility of water decreases the efficiency of the machine.

SUMMARY

The object underlying the invention is to have a piston machine with high efficiency at low costs.

This object is solved with a hydraulic piston machine as described at the outset in that the insert comprises a section which extends out of the hollow.

The insert fills not only the interior of the piston, i.e. the hollow, but extends out of the hollow so that a liquid filled dead volume out of the piston can be reduced thus increasing the efficiency of the piston machine.

In an embodiment of the invention the section comprises a diameter decreasing in a direction away from the hollow. In this way good flow conditions for the liquid flowing into and out of the cylinder are established.

In an embodiment of the invention the section is of conical form. This is a simple way to produce the decreasing diameter.

In an embodiment of the invention the piston is arranged in a cylinder drum cooperating with a valve plate, wherein a pressure arrangement is arranged between the cylinder drum and the valve plate and the section extends into the pressure arrangement. The pressure arrangement is known, for example, from U.S. Pat. No. 5,730,043 A. The pressure arrangement may have has two functions: It creates a hydraulically driven force that pushes the valve plate against the port plate and it compensates angular misalignment between the cylinder block and the port plate, so that the valve plate is always pressed flush against the port plate to form a seal. The pressure arrangement comprises at least one channel connecting the cylinder in which the piston is moveable to the valve plate. The section extending out of the hollow of the piston can now extend into the pressure arrangement to reduce the dead volume of the channel.

In an embodiment of the invention the insert is secured in the hollow at a first position and at a second position, the first and second positions having a predetermined distance to each other. When the piston is arranged in a cylinder drum of an axial piston machine, there are centrifugal forces acting on the piston and likewise on the insert in the piston. When the insert is secured at two positions having a predetermined distance to each other, tilting of the insert in the hollow is prevented. Thus, the position of the section extending out of the hollow in the dead volume can be reliably maintained. This is in particular advantageous, when the section extends into the pressure arrangement.

In an embodiment of the invention the first position is located on one side of a center mass of the insert and the second position is located on the other side of the center of mass of the insert. The risk of tilting of the insert in the hollow is further reduced and a movement of the insert in the hollow can be prevented thus preventing wear of the insert.

In an embodiment of the invention the insert is secured in the first position axially and radially and secured in the second position radially only. Thus, an over-determination of the position is avoided.

In an embodiment of the invention the insert is secured in the first position by means of a first pliable ring and in the second position by means of a second pliable ring. The pliable rings can be deformed during the insertion of the insert into the hollow. After insertion of the insert into the hollow the pliable rings secure the insert in the piston thereby defining a position of the insert in the hollow which can be maintained even against forces which can be produced by centrifugal forces during higher working speeds of the piston.

In an embodiment of the invention the second pliable ring rests against a bottom of the hollow. The bottom forms an end stop for the movement of the second ring. Thus, the position of the second ring is reliably determined.

In an embodiment of the invention the insert comprises a conical section near the bottom and the second pliable ring is arranged around the conical section. Thus, the insert can be centered with respect to the second ring and thus can be centered with respect to the axis of the piston.

In an embodiment of the invention at least the first ring comprises at least one thin section having a radial extent smaller than the largest radial extent of the ring. This is in particular useful, when a gap is formed between the insert and the wall of the hole. The gap has two advantages. It prevents a contact between the insert and the wall of the hollow and prevents accordingly a wear of the insert or the wall which could result from a movement of the insert in relation to the wall. Furthermore, the gap allows a flow of fluid along the wall of the piston which can be used for cooling the piston. The thin section allows liquid to pass the first ring and to enter the gap.

In an embodiment of the invention the ring comprises a number of blocks separating by thin sections. The ring is formed by a succession of blocks and thin sections. Thus, there are provided a number of fluid passages passing the first ring and if the second ring is formed in the same manner a number of fluid passages passing the second ring.

In an embodiment of the invention the blocks are spaced equidistantly. When the blocks are distributed evenly around the circumference of the insert they ensure even distribution of the fluid flow in the gap between the insert and the piston and minimize the form defects in the roundness of the piston caused by pressing the insert into the hollow. The rings ensures that the insert is accurately centered inside the piston.

In an embodiment of the invention the thin sections have an axial extension smaller than the axial extension of the blocks. The thin sections form a sort of spring allowing the deformation of the ring when the insert is inserted into the hollow. Furthermore, in the second ring the smaller sections allow a fluid to pass between the second ring and the bottom of the hollow.

In an embodiment of the invention the first ring and the second ring have the same form. This facilitates the assembly of the piston and the insert. It is not necessary to take care about the form of the ring in the respective position at both ends of the insert.

BRIEF DESCRIPTION OF THE DRAWINGS

The invention will now be described in more detail with reference to the drawing, wherein.

DETAILED DESCRIPTION

Figure 1:
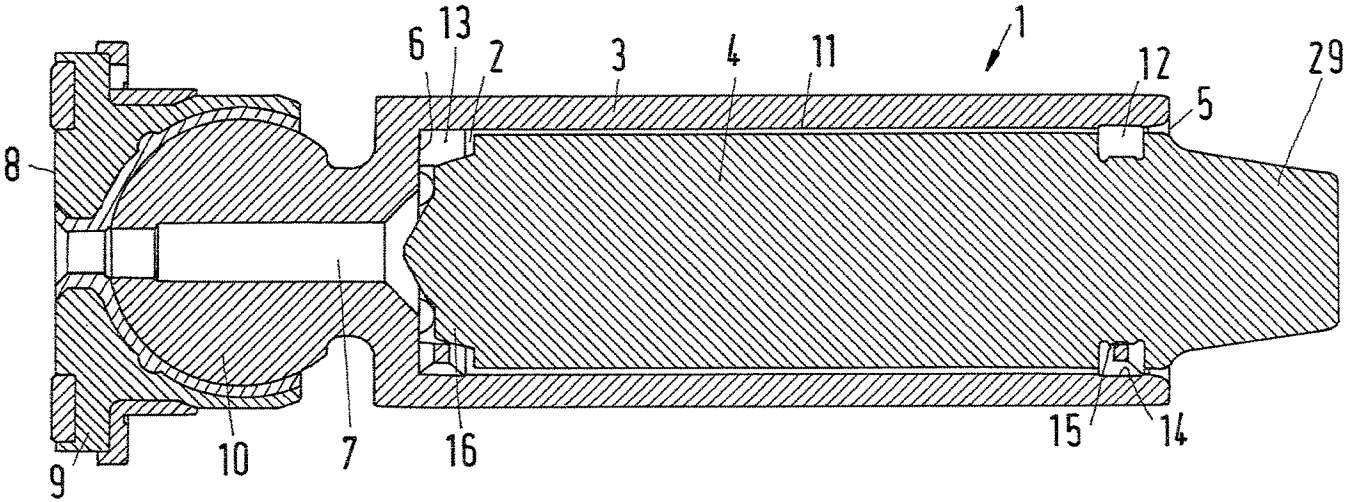
FIG. 1 shows a longitudinal section of a piston according to line A-A of FIG. 2.
Figure 2:
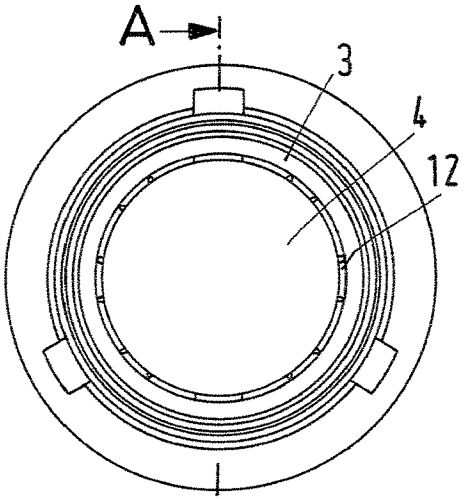
FIG. 2 shows a top view of the piston.

FIG. 1 shows a sectional view of a piston 1 of a hydraulic piston machine. The piston 1 comprises a hollow 2 surrounded by a wall 3. An insert 4 is arranged in the hollow 2.

The insert 4 is made of a ceramic material or another light weight and stiff material which cannot be compressed. A possible material is also a fibre reinforced plastic material, in particular a fibre reinforced polymer like PEEK (Polyetheretherketone)

The hollow 2 comprises an open end 5 through which the insert 4 can be mounted in the hollow 2. Furthermore, the hollow 2 comprises a bottom 6 at the opposite end. The bottom 6 is basically closed except a channel 7 through which liquid can flow to reach a hydrostatic bearing face 8 of a slider shoe 9. The slider shoe 9 is mounted on a ball 10 of the piston, as it is known in the art. During operation the slider shoe 9 rests against an inclined swash plate and is held against the swash plate by means of a retainer plate (not shown).

A gap 11 is formed between the insert 4 and the wall 3.

The insert 4 is fixed in the hollow 2 by means of a first pliable ring 12 and a second pliable ring 13. The first pliable ring 12 is arranged in an inner groove 14 in the wall 3 and in an outer groove 15 of the insert 4. The inner groove 14 and the outer groove 15 are located adjacent the open end 5 of the hollow 2.

The insert 4 comprises a conical section 16 at or near the end remote from the open end of the hollow 2. The second pliable ring 13 is arranged around the conical section 16 and rests against the bottom 6.

The first pliable ring 12 secures an axial position of the insert 4 in the piston 1 and at the same time secures a radial position of the insert 4 in the hollow 2. The first pliable ring 12 centers the insert 4 with respect to the piston 1 near the open end 5 of the hollow 2.

The second pliable ring 13 secures only a radial position of the insert 4 in the hollow 2. The two pliable rings 12, 13 are arranged with a certain distance to each other along the longitudinal extension of the insert 4. More precisely, they are arranged on both sides of a center of mass of the insert 4. Thus, they prevent a tilting of the insert 4 with respect to the wall 3.

Figure 3:
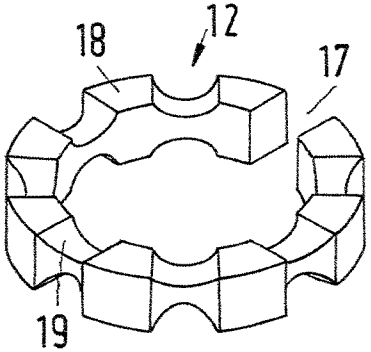
FIG. 3 shows a pliable ring in perspective view.
Figure 4:
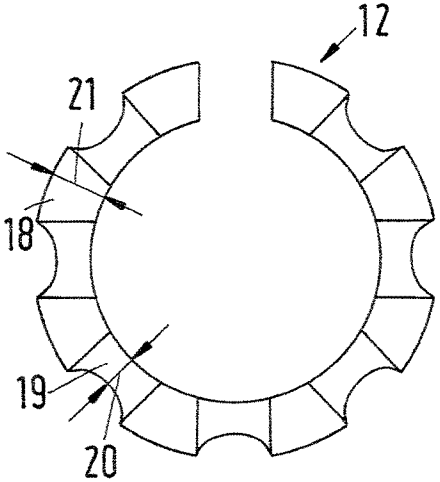
FIG. 4 shows a top view of the ring.
Figure 5:
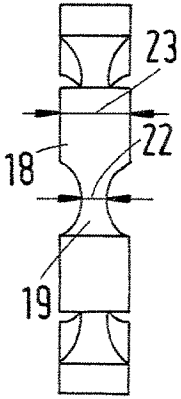
FIG. 5 shows a side view of the ring.

FIGS. 3 to 5 show the first pliable ring 12. In a preferred embodiment of the invention, the second pliable ring 13 has the same form.

The ring 12 is not closed, but open in circumferential direction, i.e. it comprises a clearance 17 in circumferential direction. In an embodiment not shown, the ring 12 can be closed in circumferential direction.

The ring 12 comprises a number of blocks 18 which are evenly distributed in circumferential direction. In other words, the blocks 18 are spaced equidistantly. This is true for the blocks 18 on both sides of the clearance 17.

Two adjacent blocks 18 are connected by means of a thin section 19. The thin section 19 comprises (FIG. 4) a radial extent 20 which is smaller than a radial extent 21 of the blocks 18 which is the largest radial extent of the ring 12.

Furthermore, the thin sections 19 have an axial extension 22 which is smaller than an axial extension 23 of the blocks 18.

Such a construction has the following effect. Due to the smaller radial extent 20 of the thin sections 19 a passage for a fluid is formed through which the fluid can enter the gap 11 between the insert 4 and the wall 3. Furthermore, the thin sections 19 allow for a deformation of the ring 12 which is necessary to mount the insert 4 together with the rings 12, 13 in the hollow 2. When the second ring 13 has the same form, the fluid can flow past the second ring towards the hydrostatic bearing 8.

When the insert 4 is mounted by pressing it into the hollow 2, the rings 12, 13 are plastically deformed by an amount which varies slightly depending on the production tolerances of the piston and the insert. The first ring 12 flows into the inner groove 14 of the wall 3, so that the axial position of the insert 4 inside the hollow 2 is locked and well defined. The primary function of the second ring 13 is to center the insert 4 inside the piston 1.

The combination of the second pliable ring 13 at the bottom 6 of the hollow 2 and the conical section 16 of the insert 4 ensures good centering of the tip of the insert 4 even if production tolerances for the piston 1 and the insert 4 cause significant variations in the axial clearance between the tip of the insert 4 and the bottom 6 of the hollow 2 in the piston 1.

Thus, the two ends of the insert 4 are locked against radial movements inside the piston 1. Otherwise the inertial forces acting on the insert 4 during operation at high speed can cause the insert 4 to make small movements inside the piston 1 that can eventually lead to wear, formation of damages, and even to the insert 4 getting dislodged over time.

The gap 11 allows a fluid flow which helps to cool the piston 1, so that the piston 1 does not overheat. If the piston 1 overheats, it can get stuck in the cylinder due to excessive thermal expansion of the piston. The first ring 12 (and the second ring 13 likewise) allow fluid to pass in the mounted condition.

The rings 12, 13 furthermore ensure that the insert 4 is accurately centered inside the hollow 2 to ensure uniform size of the gap 11 and uniform fluid flow and cooling in the gap 11. Since the blocks 18 of the rings 12, 13 are placed equidistantly, they ensure even distribution of the fluid flow in the gap 11 and minimize the form defects in the roundness of the piston caused by pressing the insert 4 into the piston.

The piston 1, more precisely the wall 3 of the piston is made of a material with high strength that can withstand the loads on the piston. It is a material with good tribological properties to ensure low frictional losses and low wear of the piston and the components it interfaces with. Finally, the material of the piston must be compatible with the fluid in the piston machine. This will often lead to the piston being made of metal with a high density. The hollow 2 reduces the mass.

Figure 6:
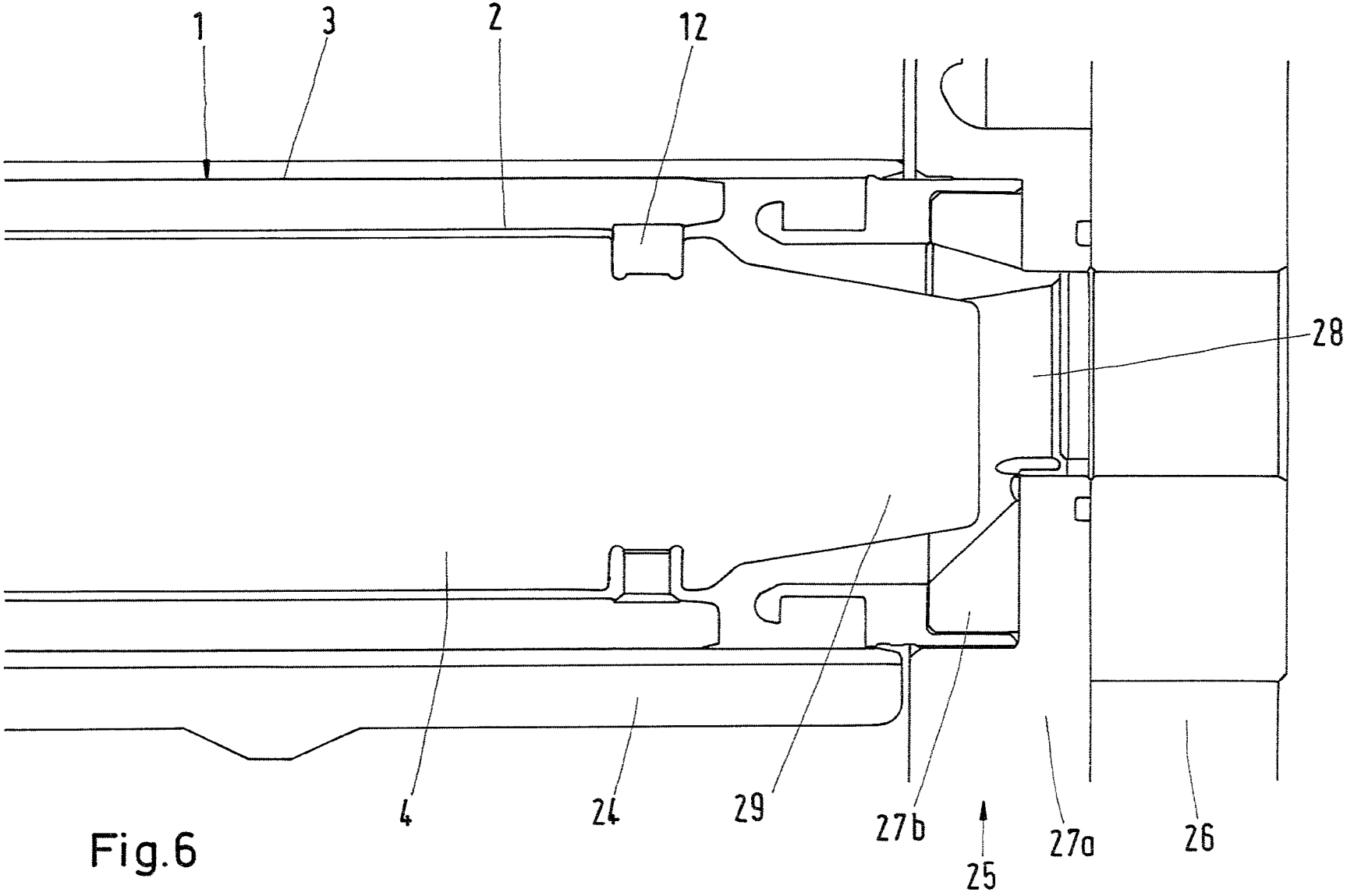
FIG. 6 shows a sectional view of an end of the insert extending into a pressure arrangement.

FIG. 6 shows a sectional view of an end of the insert 4 in an axial pump. The axial piston pump comprises a cylinder drum 24 which is rotatable around an axis during operation. A pressure arrangement 25 is arranged between the cylinder drum 24 and a valve plate 26. The pressure arrangement 25 comprises a cylinder part 27*a* and a piston part 27*b*.

The pressure arrangement 25 comprises a channel 28. The insert 4 comprises a section 29 which extends out of the hollow 2 and into the pressure arrangement 25, in particular into the channel 28.

The section 29 comprises a diameter decreasing in a direction away from the hollow 2. As can be seen in FIG. 6, the section 29 is of conical form.

When the radius of the section 29 gets smaller in the direction of the pressure arrangement 25, narrow passages for the fluid to the pressure shoe 9 are avoided. The longer the piston 1 moves away from the top dead center the more velocity the piston has and therefore more fluid has to go through the pressure arrangement 25. When the radius of the section 29 of the insert 4 gets smaller towards the pressure arrangement 25, there will be more "space" between the pressure arrangement 25 and the section 29 of the insert 4, when the piston distance from the top dead center gets bigger.

Thus, although the section 29 decreases the dead volume within the pressure arrangement 25, it does not adversely affect the filling of the cylinder in the cylinder drum.

The insert 4 reduces the compressibility in the volume in which the piston is moved by filling a significant fraction of the dead volume with a material with higher bulk modules than the fluid but with a lower density than the material of the wall 3 and other parts of the piston 1. The material of the insert 4 must be compatible with the fluid but does not need to have the strength and tribological properties of the material of the rest of the piston 1. The use of the two pliable rings 12, 13 helps to reduce the requirements for the strength of the material of the insert 4 because the gap 11 between the insert 4 and the wall 3 enables the insert 4 to remain straight even if the wall 3 itself is deformed by external loads. This enables the use of materials for the insert 4 with very high stiffness but low strengths, such as for extents light weight ceramics, without risking that bending loads are transferred from the piston to the insert 4.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic piston machine comprising a piston having a hollow surrounded by a wall and an insert arranged in the hollow, wherein the insert comprises a section which extends out of the hollow, wherein the piston is arranged in a cylinder drum cooperating with a valve plate, wherein a pressure arrangement which is arranged between the cylinder drum and the valve plate includes a piston part that extends into the cylinder drum and defines a channel having a cross-sectional area less than a cross-sectional area of the piston, wherein the section of the insert extends into the channel of the pressure arrangement during at least a portion of a piston stroke, wherein the insert is secured in the hollow at a first position and at a second position, the first and second positions having a predetermined distance to each other, and wherein the insert is secured in the first position axially and radially and secured in the second position radially only.

2. The machine according to claim 1, wherein the section comprises a diameter decreasing in a direction away from the hollow.

3. The machine according to claim 2, wherein the section is of a conical form that has been truncated.

4. The machine according to claim 1, wherein the first position is located on one side of a center of mass of the insert and the second position is located on the other side of the center of mass of the insert.

5. The machine according to claim 1, wherein the insert is secured in the first position by means of a first pliable ring and in the second position by means of a second pliable ring.

6. The machine according to claim 5, wherein the second pliable ring rests against a bottom of the hollow.

7. The machine according to claim 6, wherein the insert comprises a conical section at the end of the insert and the second pliable ring is arranged around the conical section.

8. The machine according to claim 1, wherein at least a first ring comprises at least one thin section having a radial extent smaller than the largest radial extent of the ring and wherein the insert is secured in the first position by means of the first ring.

9. The machine according to claim 8, wherein the first ring comprises a number of blocks separated by the at least one thin section.

10. The machine according to claim 9, wherein the blocks are spaced equidistantly.

11. The machine according to claim 9, wherein the at least one thin section has an axial extension smaller than the axial extension of the blocks.

12. The machine according to claim 1, wherein a first ring and a second ring have the same form, wherein the insert is secured in the first position by means of the first ring and wherein the insert is secured in the second position by means of the second ring.

13. The machine according to claim 1, wherein a gap configured to allow a flow of fluid between the insert and the wall of the piston is provided along the entire length of the insert within the piston.

14. A hydraulic piston machine comprising a piston having a hollow surrounded by a wall and an insert arranged in the hollow, wherein the insert comprises a section which extends out of the hollow, wherein the piston is arranged in a cylinder drum cooperating with a valve plate, wherein a pressure arrangement is arranged between the cylinder drum and the valve plate and the section extends into the pressure arrangement, wherein the insert is secured in the hollow at a first position and at a second position, the first and second positions having a predetermined distance to each other, wherein the insert is secured in the first position by means of a first pliable ring and in the second position by means of a second pliable ring, wherein the second pliable ring rests against a bottom of the hollow, and wherein the insert comprises a conical section at the end of the insert and the second pliable ring is arranged around the conical section.

15. The machine according to claim 14, wherein the insert is secured in the first position axially and radially and secured in the second position radially only.

16. The machine according to claim 14, wherein a gap configured to allow a flow of fluid between the insert and the wall of the piston is provided along the entire length of the insert within the piston.

17. A hydraulic piston machine comprising a piston having a hollow surrounded by a wall and an insert arranged in the hollow, wherein the insert comprises a section which extends out of the hollow, wherein the piston is arranged in a cylinder drum cooperating with a valve plate, wherein a pressure arrangement is arranged between the cylinder drum and the valve plate and the section extends into the pressure arrangement, wherein at least a first ring comprises at least one thin section having a radial extent smaller than the largest radial extent of the ring and wherein the insert is secured in a first position by means of the first ring, wherein the first ring comprises a number of blocks separated by the at least one thin section, wherein the at least one thin section has an axial extension smaller than the axial extension of the blocks, and wherein a gap configured to allow a flow of fluid between the insert and the wall of the piston is provided along the entire length of the insert within the piston.

18. The machine according to claim 17, wherein the insert is secured in the hollow at the first position and at a second position, the first and second positions having a predetermined distance to each other.

* * * * *